US005115840A

United States Patent [19]

Yamada

[11] Patent Number: 5,115,840

[45] Date of Patent: May 26, 1992

[54] CONTROL OF LOWER LIMIT OF JET PRESSURE FOR A PICKING NOZZLE

[75] Inventor: Shigeo Yamada, Komatsu, Japan

[73] Assignee: Tsudakoma Kogyo Kabushiki Kaisha, Kanazawa, Japan

[21] Appl. No.: 627,356

[22] Filed: Dec. 14, 1990

[30] Foreign Application Priority Data

Dec. 28, 1989 [JP] Japan ..... 1-340080

[51] Int. Cl.[5] ..... D03D 47/30

[52] U.S. Cl. ..... 139/435.2

[58] Field of Search ..... 139/435.2

[56] References Cited

U.S. PATENT DOCUMENTS 4,732,179 3/1988 Takegawa ..... 139/435.2
4,827,990 5/1989 Takegawa ..... 139/435.2
5,031,672 7/1991 Wahhoud et al. ..... 139/435.2

FOREIGN PATENT DOCUMENTS 0234064 9/1987 European Pat. Off. .
0276829 8/1988 European Pat. Off. .
63-92753 4/1988 Japan .
0092753 4/1988 Japan ..... 139/435.2

OTHER PUBLICATIONS

Japanese Patents Gazette, week 8822, Section Ch, Class D, No. AN-88151631, Derwent Publications Ltd., London, GB; & JP-A-63 092 753 (Toyoda) Apr. 23, 1988.

*Primary Examiner*—Andrew M. Falik
*Attorney, Agent, or Firm*—Oblon, Spivak, McClelland, Maier & Neustadt

[57] ABSTRACT

A control method and control apparatus for controlling jet pressure of a picking nozzle of a jet loom which includes detecting a flying characteristic of the filling yarn and inhibiting descending control of a pressure controller for controlling jet pressure when the unevenness of the flying characteristic exceeds a set allowable value. In the control apparatus, the pressure controller is positively controlled by an auxiliary controller provided with a flying characteristic detection mechanism, an unevenness calculation mechanism and a comparison mechanism.

8 Claims, 3 Drawing Sheets

CONTROL OF LOWER LIMIT OF JET PRESSURE FOR A PICKING NOZZLE

BACKGROUND OF THE INVENTION

This invention relates to a control method for jet pressure of a picking nozzle in a loom and control apparatus therefor in which in a jet loom, even when the flying characteristic of filling yarns is varied, the stable picking operation may be continued.

In a jet loom, particularly in an air jet room, when the flying characteristic of filling yarns used for weaving is changed, picking sometimes becomes unstable. It is contemplated that such unstable picking principally results from the fact that air resistance changes since a variation in yarn properties such as coarseness of yarns, sizes of fuzz, etc. occurs lengthwise of the filling yarns.

In view of the foregoing, various procedures have been proposed in order to continuously perform stable picking operation even when the flying characteristic of the filling yarns is changed. In the most basic procedure, a mechanical angle of a loom (hereinafter referred to as an arrival angle of filling yarns) at which a filling yarn having a predetermined length has-been picked is monitored during picking to determine the variation of the flying characteristic of the filling yarn according to a detected change of the arrival angle, and the jet pressure of a main nozzle and a subnozzle (hereinafter referred to as a picking nozzle) for picking is controlled accordingly.

Thereby, when the flying characteristic of the filling yarn is declined and a delay of the arrival angle is detected, the jet pressure is controlled so as to be increased in order to correct it. On the other hand, for the advancement of the arrival angle, the jet pressure is controlled to be lowered whereby the arrival angle of the filling yarn is maintained to be constant.

In controlling the jet pressure of the picking nozzle as described above, when the jet pressure is set so as to be extremely high or conversely extremely low for some cause, broken yarns, short-picking, looseness, etc. sometimes occur. Therefore, it has been proposed to provide a suitable upper limit value and lower limit value for the control range of the jet pressure (for example, Japanese Patent Application Laid-Open (Kokai) No. 63(1988)-92753).

However, according to the prior art as described, there is a problem in that it is not always easy to determine a proper control range of the jet pressure. That is, generally, the flying characteristic of the filling yarns varies along with a yarn supply package and even one and the same supply package is different in flying characteristics in its outer layer portion and inner layer portion. Therefore, even if the upper limit value and lower limit value of the jet pressure are simply manually set, the jet pressure to be controlled is not always suited to the flying characteristic of the filling yarns being supplied. Accordingly, it is difficult to positively realize stable picking.

It is to be noted that the upper limit value of the jet pressure is sufficiently determined such that the occurrence of broken filling yarn does not occur, and therefore no significant problem will occur even if a fixed value is manually set. On the other hand, unless the lower limit value is set properly, the jet pressure cannot be sufficiently lowered. For this reason, the arrival angle becomes abnormally advanced or conversely the jet pressure is excessively lowered, possibly giving rise to occurrence of picking defects such as looseness, short-picking, etc.

Generally, when a jet pressure P of the picking is nozzle lowered, an arrival angle $\theta e$ increases its unevenness $\Delta\theta e$ for each picking as shown in FIG. 6. Even if the average arrival angle $\theta e$ is not greatly varied from a target arrival angle $\theta eo$, there is possibly exceeded an allowable arrival limit $\Delta\theta eo$ momentarily due to the unevenness $\Delta\theta e$.

SUMMARY OF THE INVENTION

In view of the aforesaid problems noted above with respect to prior art, a principal object of the present invention is to provide a method for control of jet pressure of a picking nozzle in a loom and a control apparatus therefor in which the flying characteristic of a filling yarn for each picking is monitored, and at least a lower limit value of jet pressure is automatically set on the basis thereof to thereby realize a continuation of stable picking operation without the occurrence of picking defects such as looseness, short-picking or the like.

According to the control method of the present invention, even if the flying characteristic of the filling yarns is varied, the lower limit value of the jet pressure of the picking nozzle can be optimally automatically set. That is, when the flying characteristic of the filling yarns increases, the pressure controller controls the jet pressure P of the picking nozzle in a descending direction in order to correct it. The arrival angle $\theta e$ of the filling yarn becomes greatly uneven in the neighbourhood of the target arrival angle $\theta eo$ for each picking with the lowering of the jet pressure P, as has been explained in connection with FIG. 6. Therefore, if a set allowable value $\Delta\theta el$ having a smaller width than the allowable arrival angle $\Delta\theta eo$ is determined as shown in FIG. 3 and when the unevenness $\Delta\theta e$ of the arrival angle $\theta e$ exceeds the set allowable value $\Delta\theta el$, the descending control of the jet pressure P is inhibited, and the jet pressure P=PL at that time is set as a lower limit value of the jet pressure P. Since the jet pressure P is no longer lowered from the lower limit value PL, the unevenness $\Delta\theta e$ of the arrival angle $\theta e$ will not increase exceed so as to the set allowable value $\Delta\theta el$. Accordingly, stable picking can be continued.

If the flying characteristic of the filling yarns is further increased after the jet pressure P has been restricted to the lower limit value PL, the arrival angle $\theta e$ advances by a deviation $\delta$ on average from the target arrival angle. However, it is easy to set the allowable value $\Delta\theta el$ so as to have the following relationship:

$$\delta < |\Delta\theta eo - \Delta\theta el| / 2 = \delta 1$$

Therefore, this point does not give rise to any substantial problem.

It is noted that the flying, characteristic of the filling yarns is determined by the arrival angle $\theta e$ and may be also detected by the mechanical angle range of the loom as a unit or the filling yarn flying time range as a unit.

The control apparatus according to the present invention is provided with a flying characteristic detection means, an unevenness calculation means and a comparison means. The unevenness of the flying characteristic of the filling yarns which is detected by the flying characteristic detection means, is calculated by the unevenness calculation means. The comparison means detects whether the calculated unevenness exceeds a set allowable value, and the comparison means causes a pressure controller to inhibit descending control of jet pressure. Thus, the method of the present invention can be easily carried out.

If an arrival angle detector is used as the flying characteristic detection means, the flying characteristic of the filling yarns can be determined by the arrival angle of the filling yarn; and if a flying time detector is used, the flying characteristic can be determined by the mechanical angle range of the loom or the filling yarn flying time using time as a unit.

W . . . filling yarn,

P, Pm, Ps . . . jet pressure, $\theta$e . . . arrival angle, t . . . filling yarn flying time, $\Delta\theta$e, $\Delta$t . . . unevenness, $\Delta\theta$el, $\Delta$tl . . . set allowable value, n . . . set pick number

DETAILED DESCRIPTION OF THE PREFERRED EMBODIMENTS

The embodiments of the present invention will be described hereinafter with reference to the drawings.

Figure 2:
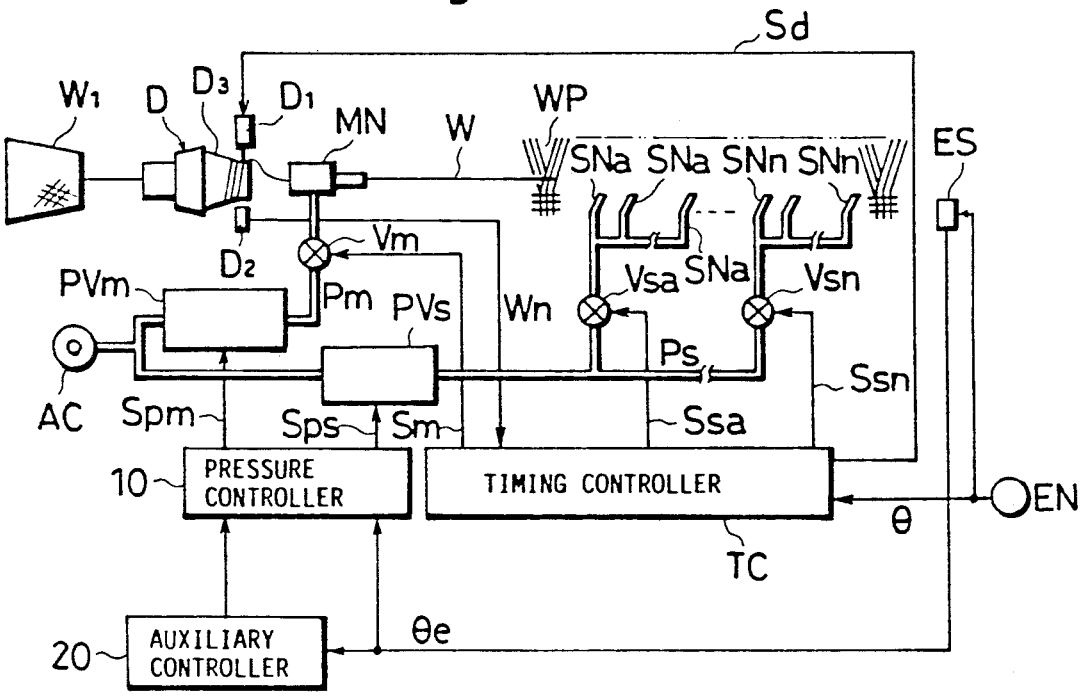
FIG. 2 is a conceptual view of the entire configuration of an air jet loom to which is applied the apparatus according to the present invention.

The loom is an air jet room as shown in FIG. 2. A filling yarn W released from a yarn supply package Wl is picked into a warp shed WP via a drum type filling yarn length-measuring and storing device (hereinafter termed a storing device) D and a main nozzle MN. A plurality of grouped subnozzles SNa . . . SNn are disposed along the travel path of the yarn W.

The storing device D is provided with a lock pin D1 and a release sensor D2. The yarn W wound about and stored On a drum D3 is picked by driving the lock pin D1 to the release position and opening valves Vm and Vsi (i =a, b . . . n) to actuate the main nozzle MN and subnozzles SNa . . . SNn in response to picking signals Sd, Sm and Ssi (i=a, b . . . n) from a timing controller TC. A length Wn of picking is measured by the release sensor D2.

The main nozzle MN and sub-nozzles SNa . . . SNn are connected to a common air source AC through closing valves Vm, Vsa, Vsi, Vsn and pressure regulating valves PVm, PVs. Jet pressures Pm and Ps are controlled by control signals Spm and Sps from a pressure controller 10. On the counter picking side of woven fabric is disposed a filling yarn feeler WF of an arrival angle detector ES for detecting an arrival angle $\theta$e of the laid filling yarn W, and a loom mechanical angle $\theta$ from an encoder EN is inputted into the arrival angle detector ES and a timing controller TC. The arrival angle detector ES inputs an output of the filling yarn feeler WF and the loom mechanical angle $\theta$ from the encoder EN, and outputs, as an arrival angle $\theta$e, the loom mechanical angle $\theta$ at the time when the yarn W arrives at the counter picking side (see FIG. 1).

Figure 1:
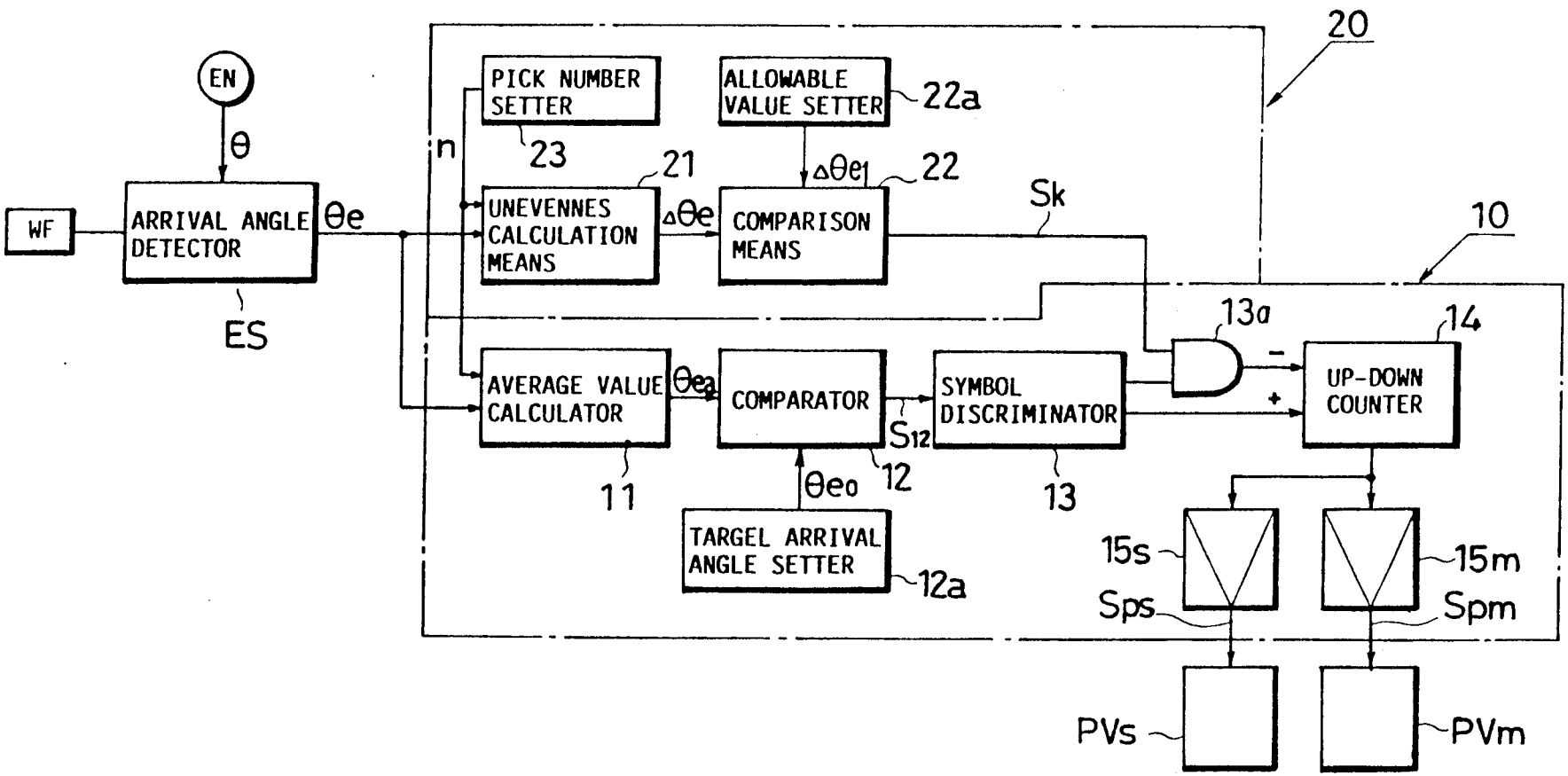
FIG. 1 is a flow chart of the entire configuration showing one example of a control apparatus according to the present invention.

A control apparatus for jet pressure of a picking nozzle of the loom comprises a combination of a pressure controller 10 and an auxiliary controller 20 as shown in FIG. 1.

The pressure controller 10 comprises an average value calculator 11, a comparator 12, a symbol discriminator 13, an up-down counter 14 and two control amplifiers 15m and 15s connected longitudinally, each of the outputs of which is inputted, as control signals Spm and Sps, into the pressure regulating valves PVm and PVs. Into the average value calculator 11 are inputted the arrival angle $\theta$e from the arrival angle detector ES and a set pick number n from a pick number setter 23 included in the auxiliary controller 20. The target arrival angle $\theta$eo from a target arrival angle setter 12*a* is inputted into the comparator 12. One output of the symbol discriminator 13 is directly connected to an addition terminal of the up down counter 14 while the other output thereof is connected to a subtraction terminal of the up-down counter 14 through a gate 13*a*.

The auxiliary controller 20 comprises an unevenness calculation means 21 and a comparison means 22 connected longitudinally. Into the unevenness calculation means 21 are branched and inputted the arrival angle $\theta$e from the, arrival angle detector ES and the set pick number n from the pick number setter 23. A set allowable value $\Delta\theta$e from an allowable value setter 22*a* is inputted into the comparison means 22, and the output thereof is outputted, as an inhibition signal Sk, to the gate 13*a* of the pressure controller 10.

Figure 3:
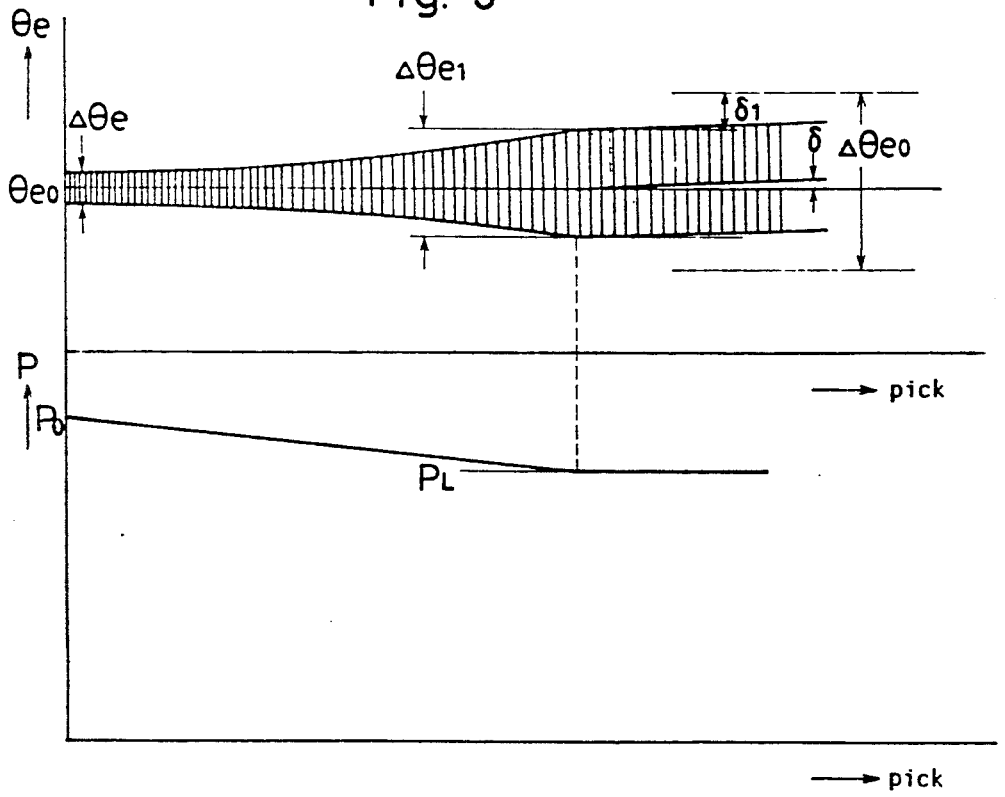
FIG. 3 is a diagram for explaining the operation according to the method of the present invention.

When the picking operation is normally executed, picking of the filling yarn W is started at a predetermined loom mechanical angle $\theta=\theta$s by the timing controller TC, in which case the arrival angle $\theta$e of the filling angle W has its average value $\theta$ea coincided with the target arrival angle $\theta$eo, for and the unevenness $\Delta\theta$e each picking is extremely small as shown at left side of FIG. 3.

In the pressure controller 10, the average value calculator 11 calculates the average value $\theta$ea of the arrival angle in the set pick number n, and the comparator 12 compares the average value $\theta$ea with the target arrival angle $\theta$eo. Since $\theta$ea$=\theta$eo, a deviation signal S12 as its output is S12=0.

Accordingly, the symbol discriminator 13 generates no output. The Jet pressures Pm and Ps of the main nozzle MN and sub-nozzles SNa . . . SNn controlled by the pressure controller 10 and pressure regulating valve PVm and PVs are a given value Pm=Ps=Po corresponding to a constant stored in advance in the up-down counter 14. However, each of the control amplifiers 15*m* and 15*s* has the Digital/Analog (D/A)-conversion function to output the control signals Spm and Sps to the pressure regulating valves PVm and PVs according to the content of the up-down counter 14, and the pressure regulating valves PVm and PVs realize the jet pressures Pm and Ps corresponding to the control signals Spm and Sps. In FIG. 3, the jet pressures Pm and Ps are collectively shown as the jet pressure P.

On the other hand, the unevenness calculation means 21 of the auxiliary controller 20 calculates the unevenness $\Delta\theta$e of the arrival angle $\theta$e. The unevenness $\Delta\theta$e herein termed denotes a suitable statistic amount including a difference between maximum and minimal values of the arrival angle $\theta$e in addition to a standard deviation of the arrival angle $\theta$e in the set pick number n.

Since at this time, the unevenness $\Delta\theta e$ is $\Delta\theta e < \Delta\theta el$, the comparison means 22 does not output the inhibition signal Sk. Accordingly, the gate 13*a* of the pressure controller 10 remains opened.

On the other hand, when the flying characteristic of the filling yarn W is varied to vary the average value $\theta ea$ of the arrival angle $\theta e$, the comparator 12 outputs the deviation signal S12 in a direction of returning it to the target arrival angle $\theta eo$. Therefore, the symbol discriminator 13 adds an output signal to the addition terminal and subtraction terminal of the up-down counter 14 according to the symbol of the deviation signal S12. Thereby the up-down counter 14 increases or decreases the Stored content, and therefore, the jet pressures Pm and Ps can be optimally controlled according to the flying characteristic of the filling yarn W.

In this manner, when the jet pressures Pm and Ps are lowered due to the increase of the flying characteristic of the filling yarn W during operation of the pressure controller 10, the unevenness $\Delta\theta e$ of the arrival angle $\theta e$ increases accordingly (FIG. 3). When the unevenness $\Delta\theta e$ exceeds the set allowable value $\Delta\theta el$, the comparison means 22 of the auxiliary controller 20 is actuated to output the inhibition signal Sk whereby the gate 13*a* of the pressure controller 10 is closed, and thereafter the pressure controller 10 assumes the state where the descending control of the jet pressures Pm and Ps is inhibited. That is, the jet pressures Pm and Ps will always maintain the value at that time as the lower limit value PL. Accordingly, if the set allowable value $\Delta\theta el$ is set with sufficient allowance $\delta l$ with respect to the allowable arrival limit $\Delta\theta eo$, the stable picking can be continued thereafter.

When the flying characteristic of the filling yarn W is further increased so that the average $\theta ea$ of the arrival angle $\theta e$ cannot maintain the $\theta ea = \theta eo$ corresponding to the jet pressure $Pm = Ps = PL$, the deviation amount $\delta$ from the target arrival angle $\theta eo$ occurs in the average value $\theta ea$. However, the loom continues normal picking if the deviation amount $\delta$ is small and unless the unevenness $\Delta\theta e$ exceeds the allowable arrival limit $\Delta\theta eo$. When the flying characteristic of the filling yarn W is restored to $\Delta\theta e \leqq \Delta\theta el$, the inhibition signal Sk is reset and therefore the pressure controller 10 can be automatically returned to the normal control operation of the jet pressures Pm and Ps.

Figure 4:
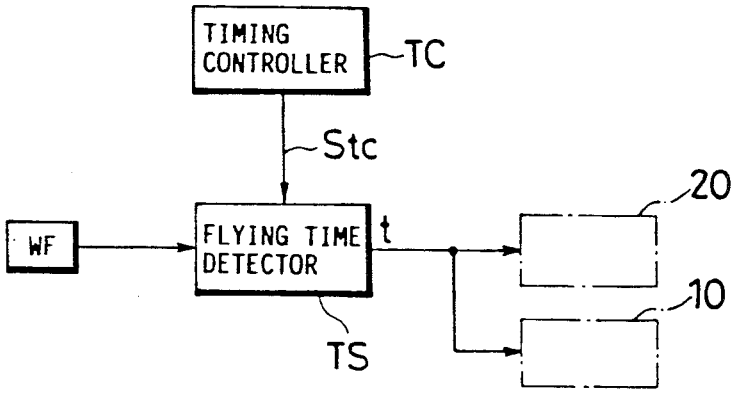
FIGS. 4 and 5 are flow charts of essential parts showing a further embodiment of the control apparatus according to the present invention.
Figure 5:
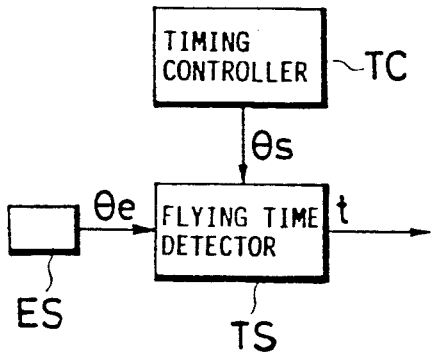
Figure 6:
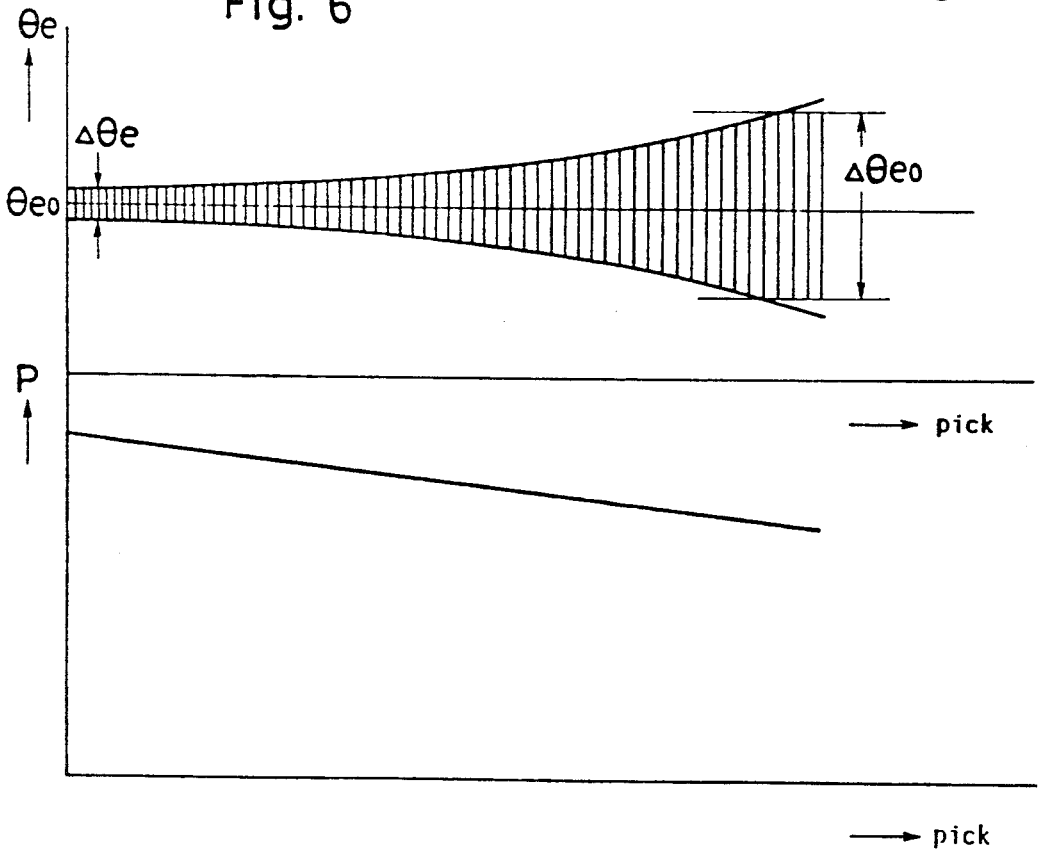
FIG. 6 is a diagram for explaining the operation according to a conventional method. In these Figures.

FIGS. 4 and 5 are flow charts of essential parts showing a further embodiment.

In the aforementioned example, the arrival angle detector ES forms flying characteristic detection means wherein the loom mechanical angle $\theta$ at the time when the filling yarn W arrives at the counter picking side is detected as the arrival angle $\theta e$ to thereby detect the flying characteristic of the filling yarn W for each picking. In place of the aforemention means, there can be used a flying time detector TS wherein the time difference between a picking start signal Stc from the timing controller TC and an output signal of a filling yarn feeler WF is measured, which time is outputted as a filling yarn flying time t, as shown in FIG. 4. The filling yarn flying time t is inputted into the pressure controller 10 and the auxiliary controller 20, and may be handled exactly in the same manner as that of the aforementioned arrival angle $\theta e$.

It is to be noted that the flying time detector TS may measure the filling yarn flying time t using the loom mechanical angle range as a unit in place of using time as the unit. That is, calculation may be made in a manner such that the picking start angle $\theta s$ from the timing controller TC and the arrival angle $\theta e$ from the arrival angle detector ES are inputted into the flying time detector TS to be $t = |\theta e - \theta s|$.

The unevenness calculation means 21 in these embodiments uses either arrival angle $\theta e$ (including arrival timing) or filling yarn flying time t using a time or loom mechanical angle $\theta$ to calculate the unevenness of the flying characteristic of the filling yarn W in the set pick number n, output of which is the unevenness $\Delta\theta e$ of the arrival angle $\theta e$ or the unevenness $\theta t$ of the filling yarn flying time t. The comparison means 22 compares the unevennesses $\Delta\theta e$ or $\theta t$ with the set allowable values $\Delta\theta el$ and $\theta tl$. When $\Delta\theta e > \Delta\theta el$ or $\theta t > \theta tl$, the comparison means outputs the inhibition signal Sk to thereby inhibit the descending control of the jet pressures Pm and Ps with respect to the pressure controller 10.

While in the above description, the Jet pressures Pm and Ps always have the relationship of $Pm = Ps = P$, it is to be noted that for example, a suitable rate setting element is incorporated on the input side of the control amplifiers 15m and 15s to thereby provide $Pm = Ps$.

Furthermore, the pressure regulating valve PVs may be disposed for each group of the sub-nozzles SNa . . . SNn so that jet pressures different for each group may be realized. That is the jet pressures of the picking nozzles composed of the main nozzle MN and sub-nozzles SNa . . . SNn are collectively used, or that of the main nozzle MN alone or these desired groups among the su nozzles SNa . . . SNn may be individually controlled by the pressure controller 10.

Moreover, the flying characteristic detection means composed of the arrival angle detector ES and the flying time detector TS may detect the flying characteristic with a suitable reference point determined in the midst of the flying path of the filling yarn W and using a time at which the yarn W arrives at the reference point as a reference in place of using the time at which the filling yarn W arrives at the counter picking side of woven fabric as a reference. Further, the output of the release sensor D2 attached to the storing device D is used in place of the output of the filling yarn feeler WF to measure the time required for picking of the filling yarn W having a predetermined picking length Wn to render the detection of the flying characteristic of the filling yarn W possible.

It is to be noted that this invention can be effectively applied to the case where the timing controller TC performs the picking control by suitably changing the picking start angle $\theta s$ and controlling the jet pressure by means of the pressure controller 10.

As described above, according to the control method of the present invention, when the unevenness of the flying characteristic each picking exceeds the set allowable value, the descending control of the jet pressure by the pressure controller is inhibited, and therefore, the jet pressure at that time can be automatically set and used as the lower limit valve, the lower limit value of the jet pressure capable of being optimally automatically set despite the variation of the flying characteristic of the filling yarn. Accordingly, stable picking operation can be continued without occurrence of picking defect.

Still furthermore, in the control apparatus according to the present invention, the auxiliary controller provided with the flying characteristic detection means, the unevenness calculation means and the comparison means is attached to the pressure controller, and when the unevenness of the flying characteristic of the filling yarn exceeds the set allowable value, the descending control of the jet pressure by means of the pressure controller is inhibited to achieve the control method as described above.

What is claimed is:

1. A control method for jet pressure of a picking nozzle controlled by variation of the flying characteristic of filling yarn, the method comprising:

calculating unevenness of the flying characteristic of the filling yarns; and detecting the flying characteristic of filling yarns for each picking; and inhibiting descent of controlling jet pressure of the picking nozzle when the unevenness of the flying characteristic exceeds a predetermined allowable value.

2. The control method for jet pressure of a picking nozzle according to claim 1, which comprises detecting the flying characteristic of said filling yarn by an arrival angle of the filling yarn to be detected.

3. The control method for jet pressure of a picking nozzle according to claim 1, which comprises detecting the flying characteristic of said filling yarn by flying time of the filling yarn to be detected.

4. The control method for jet pressure of a picking nozzle according to claim 3, which comprises detecting the flying characteristic of said filling yarn by using a loom mechanism angle range as a unit.

5. The control method for jet pressure of a picking nozzle according to claim 3, which comprises detecting the flying characteristic of said filling yarn by using time as a unit.

6. A control apparatus for jet pressure of a picking nozzle in a loom, comprising:

a pressure controller for controlling jet pressure of a picking nozzle and an auxiliary controller attached to said pressure controller, said auxiliary controller including flying characteristic detection means for detecting the flying characteristic of the filling yarn for each picking, unevenness calculation means for calculating the unevenness of the flying characteristic in a set pick number from an output of said flying characteristic detection means, and comparison means for inhibiting descending control of jet pressure of said pressure controller when unevenness of the flying characteristic exceeds a predetermined allowable value.

7. The control apparatus for jet pressure of a picking nozzle according to claim 6, wherein said flying characteristic detection means comprises an arrival angle detector for detecting an arrival angle of the filling yarn.

8. The control apparatus for jet pressure of a picking nozzle according to claim 6, wherein said flying characteristic detection means comprises a flying time detector for detecting a filling-yarn flying time.

* * * * *